US009399205B1

(12) United States Patent
Kughn

(10) Patent No.: US 9,399,205 B1
(45) **Date of Patent: *Jul. 26, 2016**

(54) ANTIFREEZE DYEING SYSTEMS AND METHODS

(76) Inventor: William C. Kughn, Stanton, CA (US)

( * ) Notice: Subject to any disclaimer, the term of this patent is extended or adjusted under 35 U.S.C. 154(b) by 901 days.

This patent is subject to a terminal disclaimer.

(21) Appl. No.: 13/619,840

(22) Filed: Sep. 14, 2012

Related U.S. Application Data

(63) Continuation-in-part of application No. 12/502,509, filed on Jul. 14, 2009, now Pat. No. 8,287,176.

(60) Provisional application No. 61/080,643, filed on Jul. 14, 2008, provisional application No. 61/101,561, filed on Sep. 30, 2008.

(51) Int. Cl.
*B01F 15/04* (2006.01)
*B01F 15/00* (2006.01)

(52) U.S. Cl.
CPC ..... *B01F 15/00824* (2013.01); *B01F 15/04* (2013.01)

(58) Field of Classification Search
CPC . B01F 15/00824; B01F 15/0216; B01F 15/04
USPC ..... 366/130, 134, 162.1, 173.1, 177.1, 366/181.8, 182.2, 190; 222/129; 206/219
See application file for complete search history.

(56) References Cited

U.S. PATENT DOCUMENTS 5,242,133 A * 9/1993 Zwick ..... 244/134 C
5,282,590 A * 2/1994 Zwick ..... 244/134 C
5,488,968 A * 2/1996 Price et al. ..... 137/1
6,065,863 A * 5/2000 Cain ..... 366/163.2
6,978,911 B2 * 12/2005 Floyd et al. ..... 222/1
6,988,637 B2 * 1/2006 Floyd et al. ..... 222/1
7,467,890 B2 * 12/2008 Patzek, IV ..... 366/165.1
7,934,680 B2 * 5/2011 Smith ..... 244/134 C
8,029,650 B1 * 10/2011 Letcher ..... 203/18
8,287,176 B1 * 10/2012 Kughn ..... 366/130
8,540,937 B2 * 9/2013 Lark et al. ..... 422/62
2004/0065674 A1 * 4/2004 Floyd et al. ..... 222/1
2004/0065675 A1 * 4/2004 Floyd et al. ..... 222/1
2004/0065681 A1 * 4/2004 Floyd et al. ..... 222/135
2004/0065682 A1 * 4/2004 Floyd et al. ..... 222/135
2004/0206778 A1 * 10/2004 Floyd et al. ..... 222/145.5
2006/0016832 A1 * 1/2006 Koch et al. ..... 222/383.1
2009/0099694 A1 * 4/2009 Trevino et al. ..... 700/265
2011/0313557 A1 * 12/2011 Hughes et al. ..... 700/97
2014/0082854 A1 * 3/2014 Landa et al. ..... 8/405

OTHER PUBLICATIONS http://www.eetcorp.com/antifreeze/antifreeze-faq.htm#q26, EET Corporation, Antifreeze FAQ and Coolants Matrix, actual publication date not known, 10 pages, Internet.

(Continued)

*Primary Examiner* — Charles Cooley
(74) *Attorney, Agent, or Firm* — Lodestar Patents, PLLC; Raymond J. E. Hall

(57) ABSTRACT

Systems and methods relating to improvements in end-user selected antifreeze engine coolant purchased at automotive retail stores. Additionally, antifreeze dyeing systems and methods are disclosed to provide single inventory bulk colorless antifreeze and small inventory custom dye to closely match Original End Manufacturer (OEM) colored antifreeze; and, reduce costs of product and inventory of multiple antifreeze colors, types and containers.

20 Claims, 5 Drawing Sheets

(56) References Cited

OTHER PUBLICATIONS http://www.filtercouncil.org/uploads/docs/TSB/English/05-2.pdf, Filter Manufacturers Council, The Color of Antifreeze, Technical Service Bulletin 05-2, Apr. 2005 (date not validated), 2 pages, Internet.

http://www.thefind.com/, Various Internet search results from around Aug. 28, 2008, date of publication unknown, 8 pages, Internet.

* cited by examiner

ANTIFREEZE DYEING SYSTEMS AND METHODS

CROSS-REFERENCE TO RELATED APPLICATION

The present application is a continuation-in-part of, and is related to and claims priority from, application Ser. No. 12/502,509, filed Jul. 14, 2009, now U.S. Pat. No. 8,287,176 B1 entitled "Antifreeze Dyeing Systems and Methods", which prior application is related to and claims priority from prior provisional application 61/080,643, filed Jul. 14, 2008, entitled "True Color System"; and, is related to and claims priority from prior provisional application Ser. No. 61/101,561, filed Sep. 30, 2008, entitled "Antifreeze Dying Systems and Methods"; and, is related to and claims priority from prior provisional application Ser. No. 61/143,654, filed Jan. 9, 2009, entitled "Antifreeze Dying Systems and Methods", the contents of all of which are incorporated herein by this reference and are not admitted to be prior art with respect to the present invention by the mention in this cross-reference section.

BACKGROUND

This invention relates to antifreeze dyeing systems and methods. More particularly, this invention relates to improvements in systems and methods for automotive engine (light duty) service to include retail outlets that sell engine coolant on multiple manufactured vehicles.

Additionally, this invention relates to improvements in systems and methods for automotive engine (light duty) service facilities (commonly referred to as service stations) and heavy duty engine service facilities (facilities that service trucks, buses, and the like) that utilize engine coolant on multiple manufactured vehicles.

Engine coolant is a generic term most often used to describe a fluid or fluids used to assist in removing heat from an engine. One type of engine coolant commonly used is known as antifreeze. Antifreeze is a mixture of products used to provide added protection to engine coolant against freezing. In addition, antifreeze also assists raising the boiling point of some engine coolants, such as water. Water is commonly used as an engine coolant to transfer heat from an engine and then release the heat through use of a radiator system in a vehicle. Water has many properties that make it ideal for acting as a coolant (heat transfer properties); however, there are certain properties of water that are not the most efficient in extreme temperatures such as below freezing (expands as a solid) and above boiling (turns to gas). Further, water can be corrosive to certain metals and materials commonly found in engines. Antifreeze generally refers to a mixture of any concentration of, but typically about, 50% ethylene glycol [or other antifreeze chemical such as propanediol ("PDO"), propylene glycol ("PG"), glycerine, or other freeze protection chemicals] and less than or equal to about 50% water (preferably distilled) with a small percentage of other corrosion inhibitors that assist lowering the corrosive effects of water engine coolant. Generally, when used with a vehicle cooling system, antifreeze increases a vehicle cooling system's performance to remove heat from the engine.

Generically, a mixture of ethylene glycol and water is a relatively clear fluid. Over the years, antifreeze mixtures have been provided in a specifically selected color by manufacturers to promote use of a specific OEM (Original Equipment Manufacturer) brand. Each respective color has been essentially selected and correlated with various vehicle manufacturers to designate minor additions or deletions of engine coolant mixtures and anti-corrosive additives. Laws, such as the Magnuson-Moss Warranty Act (15 U.S.C. 2302), provide that an original equipment manufacturer (OEM) may not make its vehicle warranty conditional on the use of any specific brand of motor oil, oil filter, antifreeze, or any other component unless the manufacturer provides it to the customer free of charge during the warranty period.

While servicing engine coolant in vehicles, service facilities and retail stores have either had to keep on hand many different types and colors of antifreeze or provide a customer different colored antifreeze for servicing. Customers may be confused to see a different color antifreeze put into in their vehicles even when such antifreeze satisfies the requirements of the manufacturer or provides satisfactory performance as an engine coolant.

No system exists that is responsive to the growing number of different colored antifreeze solutions available on the market to avoid confusion among consumers and service technicians. Therefore a need exists for such a system.

OBJECTS AND FEATURES OF THE INVENTION

A primary object and feature of the present invention is to provide a system overcoming the above-mentioned problems and meeting the above-mentioned needs.

It is a further object and feature of the present invention to provide such a system that is easy to operate.

It is a further object and feature of the present invention to provide an antifreeze dyeing system that preserves retail store shelf space.

It is a further object and feature of the present invention to provide an antifreeze dyeing system that preserves service facility space.

It is a further object and feature of the present invention to provide a system that reduces the need to stock multiple containers of OEM antifreeze.

It is a further object and feature of the present invention to provide a method of dyeing antifreeze to match an OEM antifreeze color.

A further primary object and feature of the present invention is to provide such a system that is efficient, inexpensive, cost effective, and handy. Other objects and features of this invention will become apparent with reference to the following descriptions.

SUMMARY OF THE INVENTION

In accordance with a preferred embodiment hereof, this invention provides a system relating to custom dying colorless pre-packaged vehicle engine coolant antifreeze to economically provide at least one desired engine coolant color for at least one selected vehicle type, comprising: at least one plurality of pre-packaged containers of colorless vehicle engine coolant antifreeze; and at least one plurality of antifreeze-color-dye containers; wherein each such at least one plurality of antifreeze-color-dye container comprises at least one antifreeze color-dye structured and arranged to color dye at least one of such at least one plurality of pre-packaged containers of colorless vehicle engine coolant antifreeze; wherein a selected quantity of colorless pre-packaged vehicle engine coolant antifreeze may be custom colored by transferring color-dye from at least one of such at least one plurality of antifreeze color-dye containers to at least one selected quantity of colorless pre-packaged vehicle engine coolant antifreeze. Moreover, it provides such a system wherein such antifreeze color-dye comprises at least one pre-measured color-dye packet structured and arranged to color dye at least one such at least one pre-packaged container of colorless coolant. Additionally, it provides such a system wherein such at least one pre-packaged antifreeze container comprises at least one about one-gallon container. Also, it provides such a system wherein such at least one pre-packaged antifreeze container comprises at least one container structured and arranged to contain from about one-gallon to about 5-gallons of colorless anti-freeze. In addition, it provides such a system wherein such at least one pre-packaged container of colorless vehicle engine coolant antifreeze comprises at least hybrid organic acid technology antifreeze (HOAT). And, it provides such a system wherein such at least one pre-packaged container of colorless vehicle engine coolant antifreeze at least meets the ASTM International D6210 standard for ethylene glycol coolant.

Further, it provides such a system wherein such at least one antifreeze dye comprises at least one squeezable packet structured and arranged to assist transfer of the dye to at least one such at least one pre-packaged antifreeze container. Even further, it provides such a system wherein such at least one pre-packaged container of colorless vehicle engine coolant antifreeze comprises at least one concentration of freeze protection chemical. Moreover, it provides such a system further comprising at least one chart-assessor adapted to chart-assess, relating to such at least one selected vehicle type, the at least one desired engine coolant color. Additionally, it provides such a system wherein such at least one pre-packaged container of colorless vehicle engine coolant antifreeze comprises at least hybrid organic acid technology antifreeze (HOAT). Also, it provides such a system wherein such at least one pre-packaged container of colorless vehicle engine coolant antifreeze at least meets the ASTM International D6210 standard for ethylene glycol coolant. In addition, it provides such a system wherein such at least one pre-packaged antifreeze container comprises at least one container structured and arranged to contain from about one-gallon to about 5-gallons of colorless anti-freeze.

And, it provides such a system wherein each such at least one plurality of antifreeze-color-dye containers comprises at least one-half ounce of concentrated dye structured and arranged to color-dye at least one one-gallon pre-packaged container of colorless coolant. Further, it provides such a system wherein each such at least one plurality of antifreeze-color-dye containers comprises at least one-half ounce of concentrated dye structured and arranged to color-dye at least one one-gallon pre-packaged container of colorless coolant.

In accordance with another preferred embodiment hereof, this invention provides a system relating to user-selection of at least one custom dye-able colorless pre-packaged vehicle engine coolant antifreeze to economically provide at least one desired engine coolant color for at least one selected vehicle type, comprising: at least one point of sale display comprising at least one plurality of pre-packaged containers of colorless vehicle engine coolant antifreeze; at least one plurality of antifreeze-color-dye containers; wherein each such at least one plurality of antifreeze-color-dye containers is structured and arranged to color dye at least one of such at least one plurality of pre-packaged containers of colorless vehicle engine coolant antifreeze; at least one chart-assessor structured and arranged to chart-assess, relating to such at least one selected vehicle type, the at least one desired engine coolant color; wherein such at least one chart-assessor comprises at least one color-dye selector structured and arranged to assist selection of at least one color-dye container relating to such at least one selected vehicle type antifreeze color; wherein a selected quantity of colorless pre-packaged vehicle engine coolant antifreeze may be custom colored by transferring color-dye from at least one of such at least one plurality of antifreeze color-dye containers to at least one selected quantity of colorless pre-packaged vehicle engine coolant antifreeze; wherein a selected quantity of colorless pre-packaged vehicle engine coolant antifreeze may be custom colored by transferring color-dye from at least one of such at least one plurality of antifreeze color-dye containers to at least one selected quantity of colorless pre-packaged vehicle engine coolant antifreeze; and wherein at least one user-selection of the at least one custom dye-able colorless pre-packaged vehicle engine coolant antifreeze to economically provide at least one desired engine coolant color for at least one selected vehicle type is provided.

Even further, it provides such a system wherein such at least one chart-assessor comprises at least one electronic interface structured and arranged to assist user-selection of at least one color-dye container relating to such at least one selected vehicle type antifreeze color. Even further, it provides such a system wherein such at least one point of sale display comprises at least one electronic interface structured and arranged to assist user-selection of such at least one selected vehicle type antifreeze and antifreeze color. Even further, it provides such a system wherein each such at least one plurality of antifreeze-color-dye containers comprises at least one-half ounce of concentrated dye structured and arranged to color-dye at least one one-gallon pre-packaged container of colorless coolant. Even further, it provides such a system wherein such at least one pre-packaged antifreeze container comprises at least one container structured and arranged to contain from about one-gallon to about 5-gallons of colorless anti-freeze.

In accordance with another preferred embodiment hereof, this invention provides a method relating to providing of products enabling end-user dying of at least one colorless pre-packaged vehicle-engine antifreeze coolant to economically provide at least one selected vehicle-engine antifreeze-coolant color for at least one selected vehicle type, comprising the steps of: assessing OEM antifreeze coolant requirements and colors for at least one selected set of OEM antifreeze coolant products; providing, in pre-packaged containers, at least one colorless vehicle-engine antifreeze coolant meeting substantially the OEM antifreeze coolant requirements of such selected set of OEM antifreeze coolant products; providing, in pre-packaged containers, antifreeze-color-dyes configured to color-match such at least one colorless vehicle-engine antifreeze coolant to the respective colors of the OEM antifreeze coolant products of such selected set; providing at least one chart-assessor structured and arranged to assist a user to chart-assess, relating to such at least one selected vehicle type, selection of such antifreeze-color-dye to be mixed with such at least one colorless vehicle-engine antifreeze coolant to color-match such at least one colorless vehicle-engine antifreeze coolant to the respective color of the user's OEM antifreeze coolant product; and providing at least one point of sale display containing such pre-packaged containers of such at least one colorless vehicle-engine antifreeze coolant, such pre-packaged containers of such antifreeze-color-dye, and at least one chart-assessor; wherein products enabling end-user dying of at least one colorless pre-packaged vehicle-engine antifreeze coolant to economically provide at least one selected vehicle-engine antifreeze-coolant color for at least one selected vehicle type are provided.

In accordance with a preferred embodiment hereof, this invention provides a system relating to custom dying colorless bulk vehicle engine coolant antifreeze, comprising: at least one bulk quantity of colorless vehicle engine coolant antifreeze; at least one bulk antifreeze container to contain such at least one bulk quantity of colorless vehicle engine coolant antifreeze; at least one small antifreeze container to contain at least one smaller quantity of such at least one bulk quantity of colorless vehicle engine coolant antifreeze; at least one antifreeze transferer structured and arranged to transfer such at least one smaller quantity of such at least one bulk quantity of colorless vehicle engine coolant antifreeze from such at least one bulk container to such at least one small antifreeze container; antifreeze dye adapted to color dye such at least one smaller quantity of such at least one bulk quantity of colorless vehicle engine coolant antifreeze; at least one plurality of antifreeze dye containers to contain a plurality of such antifreeze dye; and at least one antifreeze dye transferer structured and arranged to transfer such antifreeze dye from at least one of such at least one plurality of antifreeze dye containers to such at least one small antifreeze container; wherein a selected quantity of colorless bulk vehicle engine coolant antifreeze may be custom colored by transferring such selected quantity of colorless bulk vehicle engine coolant antifreeze to such at least one small antifreeze container and transferring at least one antifreeze dye to such at least one small antifreeze container; and wherein appropriate coolant for the vehicle type may be custom mixed using the bulk colorless coolant rather than the higher priced custom factory fill or OEM coolant.

Moreover, it provides such a system further comprising at least one dye measurer to measure at least one quantity of dye to be transferred by such at least one antifreeze dye transferer. Additionally, it provides such a system wherein such at least one antifreeze dye transferer comprises such at least one dye measurer. Also, it provides such a system wherein such at least one bulk quantity of colorless vehicle engine coolant/antifreeze comprises at least about a 55-gallon drum container of such colorless vehicle engine coolant antifreeze. In addition, it provides such a system wherein such at least one small antifreeze container comprises at least one about 5-gallon container. And, it provides such a system wherein such at least one small antifreeze container comprises at least one carboy having at least one inlet and at least one outlet. Further, it provides such a system wherein such at least one antifreeze transferer comprises at least one drum pump.

Even further, it provides such a system wherein such at least one drum pump comprises a 16-ounce-per-pump plastic drum pump structured and arranged to couple to a 55-gallon drum container. Moreover, it provides such a system wherein such including but not limited to at least one bulk quantity of colorless vehicle engine coolant antifreeze comprises at least Hybrid Organic Acid Technology Antifreeze or Nitrite-Molybdate Organic Acid Technology Antifreeze, Organic Acid Technology Antifreeze, or other antifreeze technologies. Additionally, it provides such a system wherein such at least one bulk quantity of colorless vehicle engine coolant antifreeze at least meets the ASTM standard D6210 relating to ethylene glycol coolant. Also, it provides such a system wherein such at least one antifreeze dye transferer and such at least one dye measurer comprise at least one bottle pump.

In accordance with another preferred embodiment hereof, this invention provides a method, relating to custom dying colorless bulk vehicle engine-coolant antifreeze, comprising the steps of: assessing the vehicle type; assessing color coolant needed; transferring from a bulk container containing bulk colorless coolant to a mixing container an amount of coolant desired for such vehicle type; transferring from one of a plurality of different color coolant dye containers, a coolant dye containing, into the mixing container, an amount of coolant dye desired to dye the coolant in the mixing container to suit the color coolant needed; and mixing; wherein appropriate colored coolant for the vehicle type may be custom mixed using the bulk colorless coolant rather than higher priced custom, OEM, or factory-fill coolant.

In accordance with another preferred embodiment hereof, this invention provides a system, relating to economically providing at least one desired engine coolant color for at least one selected vehicle type, comprising: at least one chart-assessor adapted to chart-assess, relating to such at least one selected vehicle type, such desired engine coolant color; at least one colorless coolant transferer adapted to transfer from at least one bulk engine coolant container, containing bulk colorless coolant, to at least one mixing container, an amount of coolant desired for such at least one selected vehicle type; at least one coolant dye transferer adapted to transfer from one of a plurality of different color coolant dye containers, a coolant dye, to such at least one mixing container an amount of coolant dye desired to dye such coolant in such at least one mixing container to suit the color coolant needed; and at least one mixer to mix in such at least one mixing container such transferred amount of bulk colorless coolant and such transferred amount of coolant dye; wherein appropriate coolant for the at least one selected vehicle type may be custom mixed using the bulk colorless coolant rather than higher priced custom coolant.

In accordance with another preferred embodiment hereof, this invention provides a system relating to custom dying colorless bulk vehicle engine coolant antifreeze, comprising: at least one bulk quantity of colorless vehicle engine coolant antifreeze; at least one bulk antifreeze container to contain such at least one bulk quantity of colorless vehicle engine coolant antifreeze; at least one small antifreeze container to contain at least one smaller quantity of such at least one bulk quantity of colorless vehicle engine coolant antifreeze; at least one antifreeze transferer structured and arranged to transfer such at least one smaller quantity of such at least one bulk quantity of colorless vehicle engine coolant antifreeze from such at least one bulk container to such at least one small antifreeze container; antifreeze dye adapted to color dye such at least one smaller quantity of such at least one bulk quantity of colorless vehicle engine coolant antifreeze; at least one plurality of antifreeze dye containers to contain a plurality of such antifreeze dye; at least one antifreeze dye transferer structured and arranged to transfer such antifreeze dye from at least one of such at least one plurality of antifreeze dye containers to such at least one small antifreeze container; and at least one dye measurer to measure at least one quantity of dye to be transferred by such at least one antifreeze dye transferer; wherein such at least one antifreeze dye transferer comprises such at least one dye measurer; wherein such at least one antifreeze dye transferer and such at least one dye measurer comprise at least one bottle pump; wherein a selected quantity of colorless bulk vehicle engine coolant antifreeze may be custom colored by transferring such selected quantity of colorless bulk vehicle engine coolant antifreeze to such at least one small antifreeze container and transferring at least one antifreeze dye to such at least one small antifreeze container; and wherein appropriate coolant for the vehicle type may be custom mixed using the bulk colorless coolant rather than higher priced custom coolant.

In addition, it provides such a system wherein: such at least one bulk quantity of colorless vehicle engine coolant antifreeze comprises at least about a 55-gallon drum container of such colorless vehicle engine coolant antifreeze; such at least one small antifreeze container comprises at least one carboy having at least one inlet and at least one outlet; such at least one antifreeze transferer comprises at least one drum pump; and such at least one drum pump comprises about a 16-ounce-per-pump plastic drum pump structured and arranged to couple to a 55-gallon drum container. And, it provides such a system wherein: such at least one bulk quantity of colorless vehicle engine coolant antifreeze comprises at least hybrid organic acid technology antifreeze (HOAT); and such at least one bulk quantity of colorless vehicle engine coolant antifreeze at least meets the ASTM standard D6210 standard for ethylene glycol.

In accordance with another preferred embodiment hereof, this invention provides a system, relating to economically providing a desired engine coolant color for a selected vehicle type, comprising: chart-assessor means for chart-assessing, relating to such vehicle type, such desired engine coolant color; colorless coolant transferer means for transferring from a bulk engine coolant container, containing bulk colorless coolant, to a mixing container, an amount of coolant desired for such vehicle type; coolant dye transferer means for transferring from one of a plurality of different color coolant dye containers, a coolant dye, to the mixing container an amount of coolant dye desired to dye the coolant in the mixing container to suit the color coolant needed; and mixer means for mixing in such mixing container such transferred amount of bulk colorless coolant and such transferred amount of coolant dye; wherein appropriate coolant for the vehicle type may be custom mixed using the bulk colorless coolant rather than higher priced custom coolant.

In accordance with another preferred embodiment hereof, this invention provides a system relating to custom dying colorless bulk vehicle engine coolant/antifreeze, comprising: at least one bulk quantity of colorless vehicle engine coolant antifreeze; bulk antifreeze container means for containing such at least one bulk quantity of such colorless vehicle engine coolant antifreeze; small antifreeze container means for containing at least one smaller quantity of such colorless vehicle engine coolant antifreeze; antifreeze transferer means for transferring such at least one smaller quantity of antifreeze from such bulk container means to such small antifreeze container means; antifreeze dye means for colored dying of such at least one smaller quantity of colorless vehicle engine coolant antifreeze; at least one plurality of antifreeze dye container means for containing a plurality of such antifreeze dye means; and antifreeze dye transfer means for transferring at least one antifreeze dye from at least one of such at least one plurality of antifreeze dye container means to such second antifreeze container means; wherein a selected quantity of colorless bulk vehicle engine coolant antifreeze may be custom colored by transferring such selected quantity of colorless bulk vehicle engine coolant antifreeze to such second container means and transferring at least one antifreeze dye to such second container means; and wherein appropriate coolant for the vehicle type may be custom mixed using the bulk colorless coolant rather than higher priced custom coolant. Further, it provides such a system further comprising dye measuring means for measuring a quantity of dye to be transferred by such antifreeze dye transfer means. Even further, it provides such a system wherein such antifreeze dye transfer means comprises such dye measuring means.

In accordance with another preferred embodiment hereof, this invention provides a system comprising each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
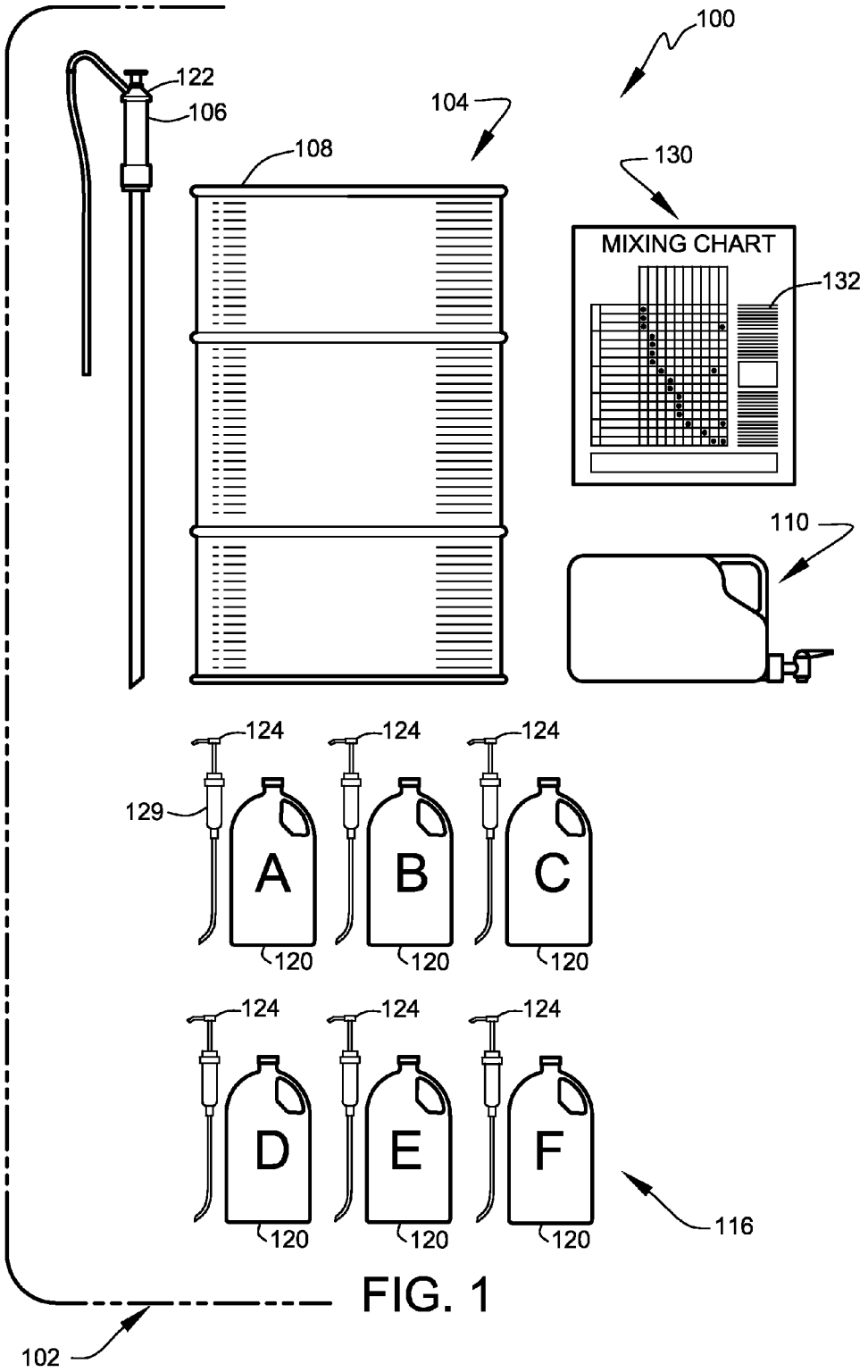
FIG. 1 shows a front view illustrating an antifreeze dying kit of the antifreeze dyeing system according to a preferred embodiment of the present invention.

FIG. 1 shows a front view illustrating an antifreeze dying kit 102 of the antifreeze dyeing system 100 according to a preferred embodiment of the present invention. Antifreeze dyeing system 100 preferably comprises components for dyeing or coloring non-colored bulk antifreeze to approximately match the color of a variety of Original Equipment Manufacturer (OEM) antifreeze (of which there are several).

Antifreeze dyeing system 100 preferably comprises at least the following components: bulk antifreeze container 104, preferably comprising non-colored bulk antifreeze engine coolant 108; at least one bulk antifreeze transferring device 106; antifreeze mixing container 110, a plurality of containers 116 comprising dye concentrate 120, at least one dye transferring device 124, preferably a plurality of such transferring devices 124, each such transferring device 124 preferably comprising at least one measurer 126; and, at least one mixing chart 130, preferably comprising all OEM colors of colored antifreeze and mixing instructions 132 to essentially match the OEM antifreeze colors using dye concentrate 120 and non-colored bulk antifreeze 108, as shown.

Service facilities performing work on vehicles where engine coolant is being added, or entirely replaced, review the manufacturers recommended engine coolant, most often an antifreeze mixture having a specific color. Such service stations then have to purchase or have inventoried one of the many different antifreeze mixtures and colors. Such inventory is costly and takes up a lot of valuable space, typically within the service station. Antifreeze is often clear when it is manufactured, and distilled water that is added to such antifreeze is also normally clear, so end manufacturers of antifreeze specifically color the antifreeze. There are many colors of antifreeze available on the market and it is very difficult to determine, simply by color, which antifreeze is being used on any particular vehicle. As such, there is much confusion on the part of a consumer and sometimes even the service station about which color engine coolant is sufficient. Most consumers expect to have a similar color placed into the radiator as was removed. As stated above, laws, such as the Magnuson-Moss Warranty Act (15 U.S.C. 2302), provide that an original equipment manufacturer (OEM) may not make its vehicle warranty conditional on the use of any specific brand of motor oil, oil filter, antifreeze, or any other component unless the manufacturer provides it to the customer free of charge during the warranty period.

Applicant provides a system for utilizing at least one antifreeze in a non-colored/colorless state, and a method for correctly coloring such antifreeze to match or closely approximate the manufacturer's recommended engine coolant color. Use of this system and methods included herein provide for an appropriate coolant for the vehicle type to be custom mixed using bulk colorless coolant rather than higher priced custom coolant.

Figure 2:
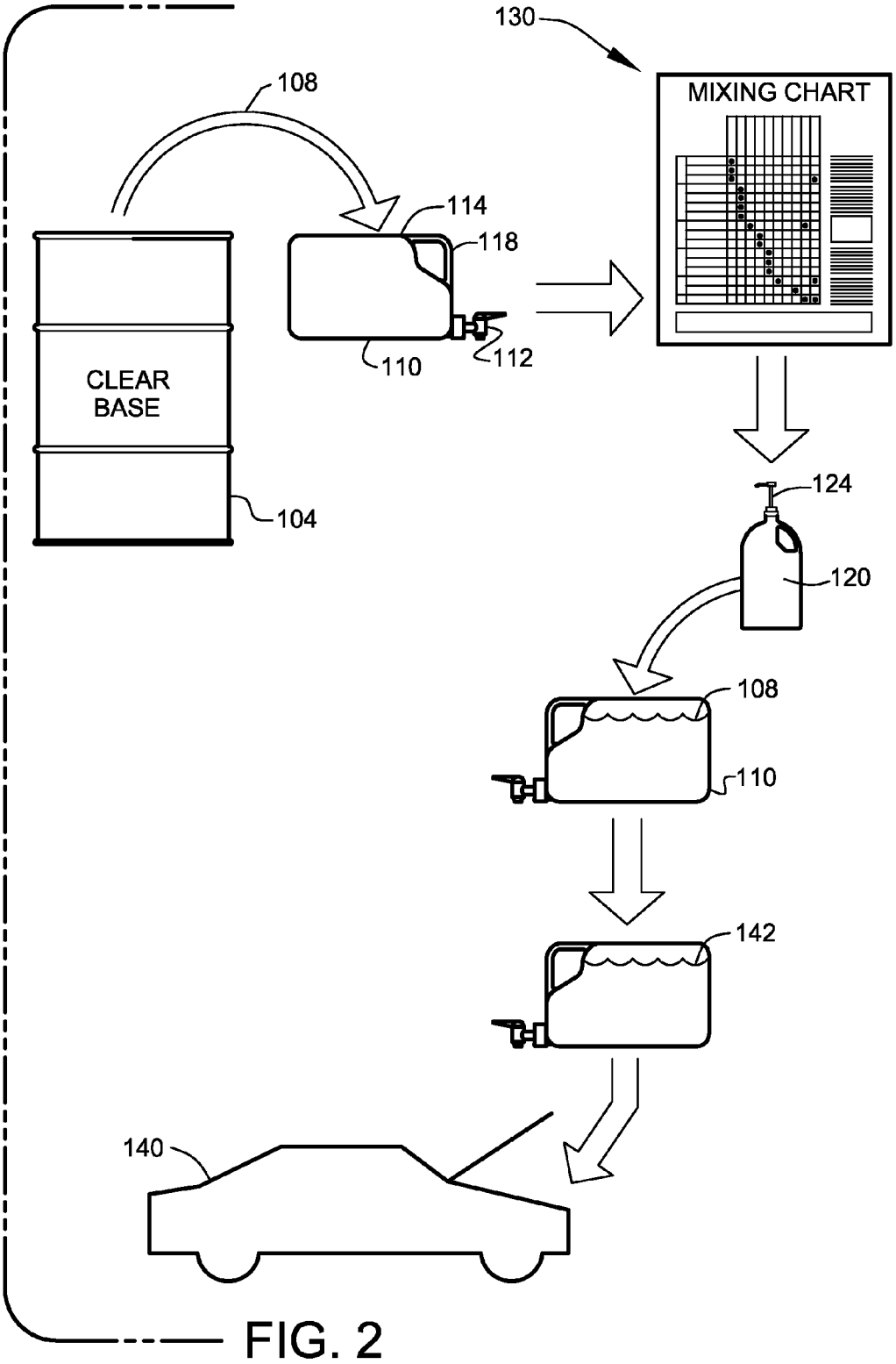
FIG. 2 shows a diagrammatic view illustrating use of the antifreeze dying kit and antifreeze dyeing system according the preferred embodiment of FIG. 1.

FIG. 2 shows a diagrammatic view illustrating use of the antifreeze dying kit 102 of the antifreeze dyeing system 100 according the preferred embodiment of FIG. 1.

Bulk antifreeze container 104 (at least embodying herein bulk antifreeze container means for containing such at least one bulk quantity of such colorless vehicle engine coolant antifreeze) preferably comprises non-colored bulk antifreeze engine coolant 108, preferably comprising, but not limited to, at least one hybrid organic acid technology antifreeze ("HOAT"). Preferably, such HOAT antifreeze meets at least the ASTM standard D6210, "Standard Specification for Fully-Formulated Glycol Base Engine Coolant for Heavy-Duty Engines," ASTM International, West Conshohocken, Pa., www.astm.org.

Further, such antifreeze preferably may meet or exceed the follow standards published by ASTM International located in West Conshohocken, Pa.: ASTM standard D6210 (referenced above), ASTM standard D4985 "Standard Specification for Low Silicate Ethylene Glycol Base Engine Coolant for Heavy Duty Engines Requiring a Pre-Charge of Supplemental Coolant Additive (SCA)", ASTM standard D3306 "Standard Specification for Glycol Base Engine Coolant for Automobile and Light-Duty Service", ASTM standard D6471 "Standard Specification for Recycled Prediluted Aqueous Glycol Base Engine Coolant (50 Volume % Minimum) for Automobile and Light-Duty Service", ASTM standard D6472 "Standard Specification for Recycled Glycol Base Engine Coolant Concentrate for Automobile and Light-Duty Service". As more standards are developed for emerging coolant technologies, the antifreeze used preferably meets then-developed standards.

Preferably, such antifreeze may include, under appropriate circumstances, ethylene glycol ("EG"), propanediol ("PDO"), propylene glycol ("PG"), and/or glycerine. Preferably, the non-colored bulk antifreeze engine coolant 108 is supplied in 55 gallon drums to the dye mixing entity (service station, etc.). HOAT antifreeze is suitable for use in both light-duty and heavy-duty engine coolant systems. HOAT antifreeze typically has a service life of about five years or about 150,000 miles of engine use prior to needing replacement. Upon reading this specification, those with ordinary skill in the art will now appreciate that, under appropriate circumstances, considering such issues as engine coolant preferences, user preferences, marketing preferences, cost, antifreeze requirements, available materials, technological advances, etc., other antifreeze arrangements such as, for example, Nitrited Organic Acid Technology antifreeze ("NOAT"), Organic Acid Technology antifreeze ("OAT"), including Nitrite-Molybdate Organic Acid Technology "NMOAT", Inorganic Acid Technology ("IAT"), Extended Service Antifreeze, etc., may suffice.

In a preferred method of use and utilizing preferred devices, non-colored bulk antifreeze engine coolant 108 (at least embodying herein at least one bulk quantity of colorless vehicle engine coolant antifreeze) is preferably transferred to at least one smaller antifreeze mixing container 110 (at least embodying herein small antifreeze container means for containing at least one smaller quantity of such colorless vehicle engine coolant antifreeze), preferably using bulk antifreeze transferring device 106, as shown. Antifreeze mixing container 110 preferably comprises at least one 5-gallon dispenser, sometimes referred to as a carboy, preferably comprising at least one inlet 114 and at least one outlet, the outlet portion preferably comprising a spigot 112, as shown. Alternately preferably, antifreeze mixing container 110 is at least one TOLCO SHUR-FILL 5-gallon dispenser available from Tolco Corporation of Toledo Ohio (http://www.tolcocorp.com/). Antifreeze mixing container 110 preferably comprises an extra-large inlet 114, preferably having about a 45 degree angle to allow a full 5-gallon fill in either a vertical or horizontal position. Antifreeze mixing container 110 preferably comprises a leak free spigot 112. Antifreeze mixing container 110 preferably measures about 19 inches long by about 10 inches high by about 9¾ inches wide. Antifreeze mixing container 110 preferably comprises at least one handle 118, as shown. Upon reading this specification, those with ordinary skill in the art will now appreciate that, under appropriate circumstances, considering such issues as design preference, user preferences, marketing preferences, cost, structural requirements, available materials, technological advances, etc., other arrangements such as, for example, larger or smaller dimensions, handles, spigots, inlets, etc., may suffice.

Bulk antifreeze transferring device 106 (at least embodying herein antifreeze transferer means for transferring such at least one smaller quantity of antifreeze from such bulk container means to such small antifreeze container means) preferably comprises a drum pump 122, preferably a TOLCO model TDP 16 ounce per pump plastic drum pump to fit a 55 gallon drum container (available from Tolco corporation of Toledo, Ohio [http://www.tolcocorp.com/]). In other words, preferably each pump action of the drum pump 122 transfers 16 ounces of non-colored bulk antifreeze engine coolant 108 preferably in a 55-gallon drum to antifreeze mixing container 110 in a smaller preferably 5-gallon container, as shown. This arrangement at least embodies herein colorless coolant transferer means for transferring from a bulk engine coolant container, containing bulk colorless coolant, to a mixing container, an amount of coolant desired for such vehicle type.

Preferably, plurality of containers 116 comprising dye concentrate 120 (at least embodying herein antifreeze dye means for colored dying of such at least one smaller quantity of colorless vehicle engine coolant antifreeze) preferably comprising about 96-ounce containers comprising dye concentrate 120 for use in coloring antifreeze as preferably available from Chromatech Incorporated in Canton, Mich. (http://www.chromatechcolors.com/colorants/automotive-fluids.php/).

Preferably, plurality of containers 116 (at least embodying herein at least one plurality of antifreeze dye container means for containing a plurality of such antifreeze dye means) comprises at least about three colors to about six colors of differently colored dye. Manufacturer specified dye colors in general are currently colors of red, green, pink, blue, yellow, and orange. Preferably, at least the following colors for antifreeze are supplied in antifreeze dying kit 102: color D11006 CHROMATINT® Uranine HS (fluorescent yellow); CHROMATINT® Orange 1835 Liquid (red); and CHROMATINT® OEM Green 30% liquid (OEM green). Upon reading this specification, those with ordinary skill in the art will now appreciate that, under appropriate circumstances, considering such issues as design preference, user preferences, marketing preferences, cost, structural requirements, available materials, technological advances, etc., other dye arrangements such as, for example, more or less dyes, color tints, dye mixing arrangements, etc., may suffice.

Preferably, at least one dye transferring device 124, preferably comprising at least one measurer 126 is affixed to the top of each respective plurality of containers 116, preferably by screwing on to the threaded portion of such containers 116. Preferably, the dye transferring device 124 (at least embodying herein antifreeze dye transfer means for transferring at least one antifreeze dye from at least one of such at least one plurality of antifreeze dye container means to such second antifreeze container means) and measurer 126 (at least embodying herein dye measuring means for measuring a quantity of dye to be transferred by such antifreeze dye transfer means) are combined into one bottle pump device 129 (at least embodying herein coolant dye transferer means for transferring from one of a plurality of different color coolant dye containers, a coolant dye, to the mixing container an amount of coolant dye desired to dye the coolant in the mixing container to suit the color coolant needed; and, at least embodying herein wherein such antifreeze dye transfer means comprises such dye measuring means), preferably a TOLCO bottle pump model GSP-02 (available from Tolco Corporation of Toledo Ohio [http://www.tolcocorp.com/]) that preferably measures about 0.25 to 1.0 oz of bottle material (dye) per stroke, as shown. Upon reading this specification, those with ordinary skill in the art will now appreciate that, under appropriate circumstances, considering such issues as design preference, user preferences, marketing preferences, cost, structural requirements, available materials, technological advances, etc., other dye transfer and measuring arrangements such as, for example, separate dye transfer and separate measuring arrangements, more or less than 0.25 oz, 0.40 oz, other measurement systems (liter, volume, weight, etc), etc., may suffice.

Antifreeze dying kit 102 preferably comprises mixing chart 130, as shown. Preferably, mixing chart 130 (at least embodying herein chart-assessor means for chart-assessing, relating to such vehicle type, such desired engine coolant color) comprises mixing instructions 132 and a listing of preferred colored antifreeze and reference for each such OEM color to be used by such auto service entity using antifreeze dying kit 102. Preferably, mixing chart 130 includes how much dye is to be added to how much antifreeze to properly color the antifreeze to closely approximate the OEM color being replaced (or as recommended by such manufacturer or other Authority). In addition, mixing instructions 132 preferably comprises specific instruction on how to use the antifreeze dying kit 102.

In use, at least one vehicle 140 is preferably presented to at least one vehicle service station for servicing at least the engine coolant portion of such vehicle 140. Preferably, vehicle 140 is identified by at least one employee of such service station and at least one recommended engine coolant antifreeze is preferably identified, preferably including the color of such engine coolant antifreeze. Mixing chart 130 preferably identifies the proper dye and proper dye mixture to be used to create such color required to closely match the engine coolant antifreeze to be replaced. Next, non-colored bulk antifreeze engine coolant 108 is preferably transferred from bulk antifreeze container 104 through bulk antifreeze transferring device 106 into antifreeze mixing container 110, as shown. As discussed above, antifreeze mixing container 110 preferably comprises about a 5 gallon container, preferably further comprising volume markings, preferably in about half-gallon increments. For example purposes, a 2½ gallon engine coolant volume for vehicle 140 will be assumed; in this example, mixing chart 130 would identify that one-half ounce of dye mixed with one gallon of non-colored bulk antifreeze engine coolant 108 will create the proper color. Preferably, dye transferring device 124 provides 1.0 ounce per pump of the dye transferring device 124; so two pumps of the dye transferring device 124 into antifreeze mixing container 110 would appropriately color one gallon of antifreeze and 5 pumps of the dye transferring device 124 would color the 2½ gallons of non-colored bulk antifreeze engine coolant 108, in the above example. The above described arrangement at least embodies herein wherein a selected quantity of colorless bulk vehicle engine coolant antifreeze may be custom colored by transferring such selected quantity of colorless bulk vehicle engine coolant antifreeze to such second container means and transferring at least one antifreeze dye to such second container means. Upon reading this specification, those with ordinary skill in the art will now appreciate that, under appropriate circumstances, considering such issues as design preference, user preferences, marketing preferences, cost, structural requirements, available materials, technological advances, etc., other dye quantity arrangements such as, for example, more or less dye, multiple colors of dye mixed together, a slightly colored bulk antifreeze, etc., may suffice.

After mixing the proper color antifreeze mix in antifreeze mixing container 110, preferably by swirling or shaking the container contents (at least embodying herein mixer means for mixing in such mixing container such transferred amount of bulk colorless coolant and such transferred amount of coolant dye), such colored antifreeze 142 is preferably transferred to the vehicle 140 and the antifreeze 142 is placed into the engine cooling system, as shown. This arrangement at least embodies herein wherein appropriate coolant for the vehicle type may be custom mixed using the bulk colorless coolant rather than higher priced custom coolant.

Figure 3:
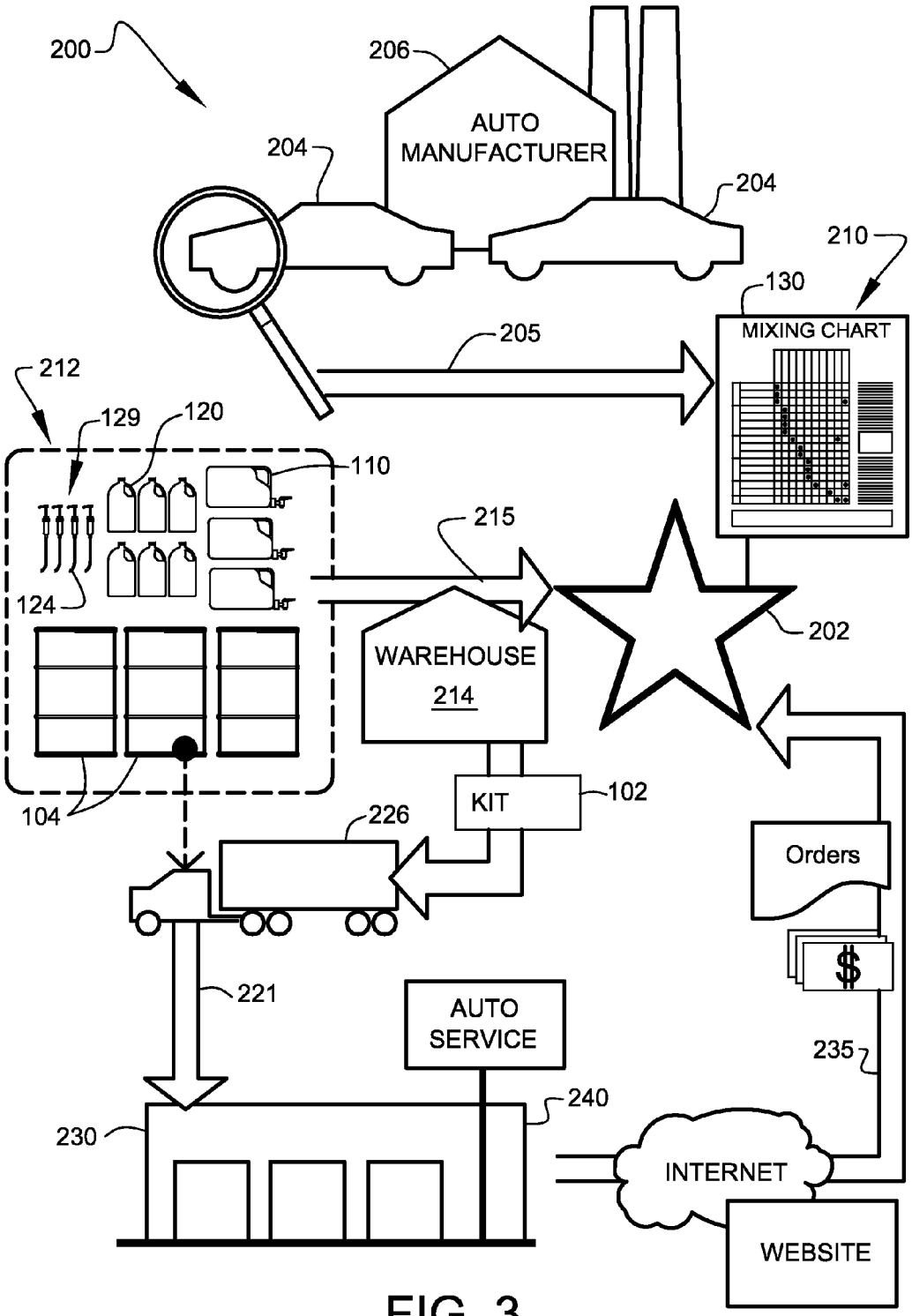
FIG. 3 shows a diagrammatic view illustrating a method of monetizing the antifreeze dyeing system according to a preferred embodiment of the present invention.

FIG. 3 shows a diagrammatic view illustrating a method 200 of monetizing the antifreeze dyeing system 100 according to a preferred embodiment of the present invention. In the preferred method 200 of monetizing antifreeze dyeing system 100, entity 202 preferably gathers information from manufacturer's 206 on antifreeze engine coolants for assorted vehicles 204 anticipated to be worked on by users of the system 100, as shown in step 205. Preferably, at least one database 210 is created utilizing the information gathered in step 205 on the appropriate antifreeze engine coolant and such database 210 preferably includes at least one mixing chart 130, as shown.

Next, as shown in step 215, entity 202 preferably sources dye kit components 212 to provide at least one antifreeze dying kit 102 to be offered for sale, as shown. Preferably, such dye kit components 212 are warehoused in at least one warehouse 214 so as to be prepared for pickup by, or shipping to, purchasers of the antifreeze dyeing system 100. Further, antifreeze dying kit 102 preferably is also warehoused in warehouse 214 and available to be shipped by truck 226 or other shipping means, as shown in step 221 to users of the antifreeze dyeing system 100, preferably auto service retail businesses 230, as shown. Upon reading this specification, those with ordinary skill in the art will now appreciate that, under appropriate circumstances, considering such issues as design preference, user preferences, marketing preferences, cost, structural requirements, available materials, technological advances, etc., other shipping means arrangements such as, for example, UNITED PARCEL SERVICE, FEDERAL EXPRESS, UNITED STATES POSTAL SERVICE, DHL, etc., may suffice.

Preferably, entity 202 monetizes the antifreeze dyeing system 100 by offering for sale through the Internet, or other advertising media, such antifreeze dyeing system 100, as shown in Step 235. Preferably, orders are received by such entities 202, and such entity 202 initiates delivery of kit components 212, as needed to provide such kit components 212 to the end-user 240. To accomplish such delivery as described above, large containers (preferably at least 55-gallon drums) of such as non-colored bulk antifreeze engine coolant 108 may be drop shipped to such end-user 240, preferably by local suppliers (to keep shipping costs low); in the examples described above end-user 240 preferably comprises at least auto service retail businesses 230. The above described method at least embodies herein a method 200 of custom dying colorless bulk vehicle engine-coolant antifreeze, comprising the steps of: assessing the vehicle type; assessing color coolant needed; transferring from a bulk container containing bulk colorless coolant to a mixing container an amount of coolant desired for such vehicle type; transferring from one of a plurality of different color coolant dye containers, a coolant dye to the mixing container an amount of coolant dye desired to dye the coolant in the mixing container to suit the color coolant needed; mixing; wherein appropriate coolant for the vehicle type may be custom mixed using the bulk colorless coolant rather than higher-priced custom coolant.

The above described method further at least embodies herein a system, relating to economically providing a desired engine coolant color for a selected vehicle type, comprising: chart-assessor means for chart-assessing, relating to such vehicle type, such desired engine coolant color; colorless coolant transferer means for transferring from a bulk engine coolant container, containing bulk colorless coolant, to a mixing container, an amount of coolant desired for such vehicle type; coolant dye transferer means for transferring from one of a plurality of different color coolant dye containers, a coolant dye, to the mixing container an amount of coolant dye desired to dye the coolant in the mixing container to suit the color coolant needed; and mixer means for mixing in such mixing container such transferred amount of bulk colorless coolant and such transferred amount of coolant dye; wherein appropriate coolant for the vehicle type may be custom mixed using the bulk colorless coolant rather than higher priced custom coolant.

Figure 4:
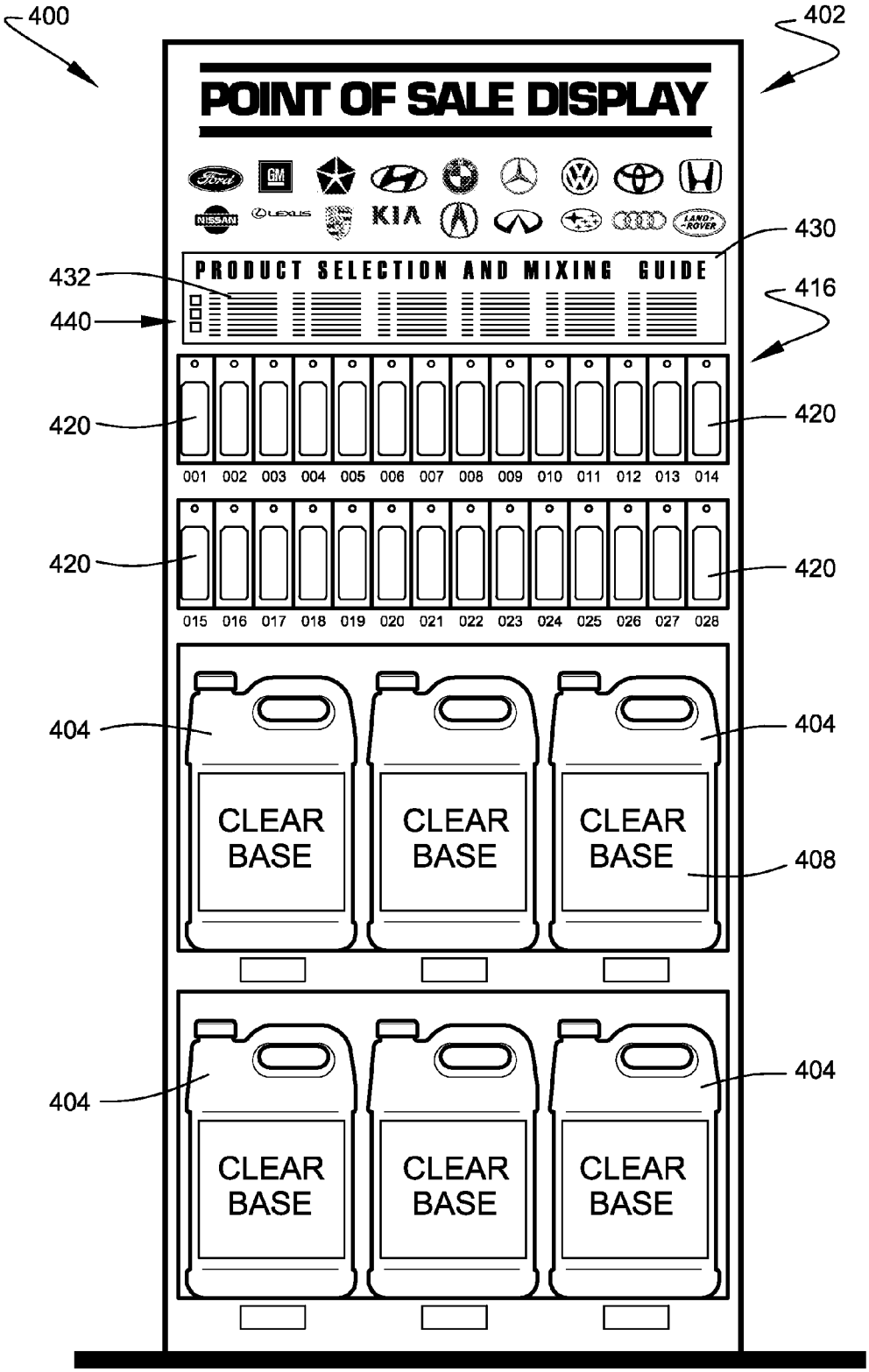
FIG. 4 shows a front view, illustrating an antifreeze dying component display of the antifreeze dyeing system, according to another preferred embodiment of the present invention.

FIG. 4 shows a front view illustrating antifreeze dying component display 402 of the antifreeze dyeing system 400 according to a preferred embodiment of the present invention. Antifreeze dyeing system 400 preferably comprises antifreeze dying component display 402 comprising components for dyeing or coloring non-colored pre-packaged antifreeze to approximately match the color of a variety of Original Equipment Manufacturer (OEM) antifreeze (of which there are several).

Antifreeze dying component display 402 preferably comprises at least the following components: a plurality of pre-packaged antifreeze containers 404, preferably comprising non-colored antifreeze engine coolant 408 (at least embodying herein at least one plurality of pre-packaged containers of colorless vehicle engine coolant antifreeze); a plurality of dye containers 416 comprising dye concentrate 420 (at least embodying herein at least one plurality of antifreeze-color-dye containers); and, at least one selection and mixing chart 430, preferably comprising substantially most OEM colors of colored antifreeze and mixing instructions 432 to essentially match the OEM antifreeze colors using dye concentrate 420 and non-colored pre-packaged antifreeze 408, as shown.

Consumers performing work on vehicles where engine coolant is being added, or entirely replaced, review the manufacturers recommended engine coolant, most often an antifreeze mixture having a specific color. Such consumers then have to purchase one of the many different antifreeze mixtures and colors from a retailer or OEM supply house. Keeping a large inventory of all the different antifreeze mixtures is costly and takes up a lot of valuable space, typically within the retailer or OEM supply house. Antifreeze is often clear when it is manufactured, and distilled water that is added to such antifreeze is also normally clear, so end manufacturers of antifreeze specifically color the antifreeze. There are many colors of antifreeze available on the market and it is very difficult to determine, simply by color, which antifreeze is being used on any particular vehicle. As such, there is much confusion on the part of a consumer and sometimes even the retailer or OEM supply house about which color engine coolant is sufficient. Most consumers expect to have a similar color placed into the radiator as was removed. As stated above, laws, such as the Magnuson-Moss Warranty Act (15 U.S.C. 2302), provide that an original equipment manufacturer (OEM) may not make its vehicle warranty conditional on the use of any specific brand of motor oil, oil filter, antifreeze, or any other component unless the manufacturer provides it to the customer free of charge during the warranty period.

Applicant provides a system for utilizing at least one antifreeze in a non-colored/colorless state, and a method for correctly coloring such antifreeze to match or closely approximate the manufacturer's recommended engine coolant color. Use of this system and methods included herein provide for an appropriate coolant for the vehicle type to be custom mixed using pre-packaged colorless coolant rather than higher priced custom coolant.

In use, a consumer who decides to service at least one vehicle preferably decides to purchase at a retailer, or OEM supply house, preferably comprising an antifreeze-dying component display 402 (at least embodying herein at least one point of sale display), as shown. Preferably, such at least one vehicle is identified by such consumer and at least one recommended engine coolant antifreeze is preferably identified, preferably including the color of such engine coolant antifreeze. Mixing chart 430 (at least embodying herein at least one chart-assessor structured and arranged to chart-assess, relating to such at least one selected vehicle type, the at least one desired engine coolant color) preferably identifies the proper dye and proper dye mixture to be used to create such color required to closely match the engine coolant antifreeze to be replaced. Alternately preferably, mixing chart 430 comprises an electronic interface 440 to assist a user in selecting the proper dye and antifreeze for such user's preferred vehicle. Such electronic interface 440 preferably selected from programmable electronic chart selectors similarly known by those knowledgeable in such art and then custom-programmed for use in choosing antifreeze/dye color mixtures.

Next, at least one or more (depending on the quantity of antifreeze coolant needed for such selected vehicle) pre-packaged antifreeze containers 404 (at least embodying herein at least one plurality of pre-packaged containers of colorless vehicle engine coolant antifreeze), preferably comprising non-colored antifreeze engine coolant 408 are selected along with a respective pre-packaged dye pack as preferably identified by mixing chart 430 (at least embodying herein at least one chart-assessor adapted to chart-assess, relating to such at least one selected vehicle type, the at least one desired engine coolant color), as shown.

Preferably, each respective dye container 416 comprises about one-half ounce of concentrated dye 420. Preferably, each respective dye container 416 comprises a squeezable packet having at least one opening through which to transfer the dye to at least one pre-packaged antifreeze container 404 (at least embodying herein wherein such at least one antifreeze dye comprises at least one squeezable packet structured and arranged to assist transfer of the dye to at least one such at least one pre-packaged antifreeze container). Upon reading this specification, those with ordinary skill in the art will now appreciate that, under appropriate circumstances, considering such issues as design preference, user preferences, marketing preferences, cost, structural requirements, available materials, technological advances, etc., other dye container arrangements such as, for example, pump, gravity-fed, breakable packets, powder dye, etc., may suffice.

Preferably, each squeezable packet contains at least one-half ounce of concentrated dye 420 (at least embodying herein wherein each such at least one plurality of antifreeze-color-dye containers comprises at least one-half ounce of concentrated dye structured and arranged to color-dye at least one one-gallon pre-packaged container of colorless coolant) Preferably, one-half ounce of concentrated dye 420 colors one gallon of antifreeze when transferred to a respective pre-packaged antifreeze container 404, preferably comprising one-gallon of antifreeze coolant. Alternately preferably, a respective pre-packaged antifreeze container 404 may contain from about one gallon to about five gallons of antifreeze coolant. Preferably, one-half ounce of concentrated dye 420 is mixed with one gallon of non-colored pre-packaged antifreeze engine coolant 408 to create the proper color (at least embodying herein wherein such antifreeze color-dye comprises at least one pre-measured color-dye packet structured and arranged to color dye at least one such at least one pre-packaged container of colorless coolant; and, at least embodying herein wherein each such at least one plurality of antifreeze-color-dye container comprises at least one antifreeze color-dye structured and arranged to color dye at least one of such at least one plurality of pre-packaged containers of colorless vehicle engine coolant antifreeze).

Upon reading this specification, those with ordinary skill in the art will now appreciate that, under appropriate circumstances, considering such issues as design preference, user preferences, marketing preferences, cost, structural requirements, available materials, technological advances, etc., other dye quantity arrangements such as, for example, more or less dye, multiple colors of dye mixed together, slightly colored bulk antifreeze, etc., may suffice. Further, upon reading this specification, those with ordinary skill in the art will now appreciate that, under appropriate circumstances, considering such issues as design preference, user preferences, marketing preferences, cost, structural requirements, available materials, technological advances, etc., other pre-packaged antifreeze coolant quantity arrangements such as, for example, metric measured containers (liters), more or less than one gallon containers, etc., may suffice.

Preferably, after mixing the proper color antifreeze mix with one gallon of non-colored pre-packaged antifreeze engine coolant 408, preferably by swirling or shaking the container contents, such now custom colored antifreeze is preferably transferred to the vehicle and the antifreeze is placed into the engine cooling system, as previously shown. This arrangement at least embodies herein wherein appropriate coolant for the vehicle type may be custom mixed using colorless coolant rather than higher-priced custom coolant. Further, the above arrangement at least embodies herein wherein a selected quantity of colorless pre-packaged vehicle engine coolant antifreeze may be custom colored by transferring color-dye from at least one of such at least one plurality of antifreeze color-dye containers to at least one selected quantity of colorless pre-packaged vehicle engine coolant antifreeze.

Figure 5:
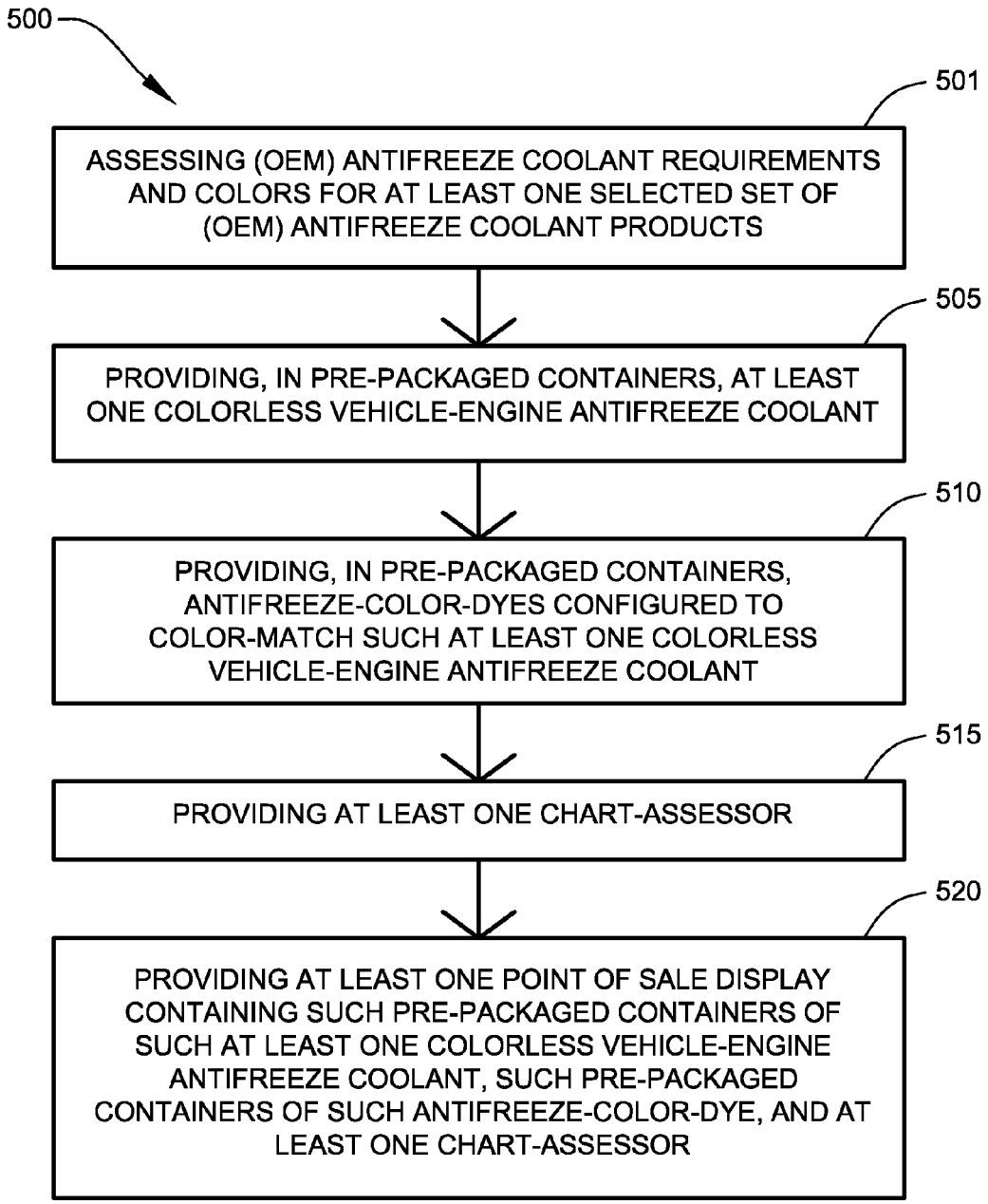
FIG. 5 shows a flow diagram indicating preferred steps of a method for correctly coloring such antifreeze to match or closely approximate the manufacturer's recommended engine coolant color, according to preferred apparatus and methods of the present invention.

Additionally, Applicant preferably provides a method for correctly coloring such antifreeze to match or closely approximate the manufacturer's recommended engine coolant color. In this regard, FIG. 5 shows a flow diagram indicating preferred steps of method 500, which generally relates to providing of products enabling end-user dying of at least one colorless pre-packaged vehicle-engine antifreeze coolant to economically provide at least one selected vehicle-engine antifreeze-coolant color for at least one selected vehicle type. Such preferred method 500 preferably comprises: preferred step 501 of assessing OEM antifreeze coolant requirements and colors for at least one selected set of OEM antifreeze coolant products; preferred step 505 of providing, in pre-packaged containers, at least one colorless vehicle-engine antifreeze coolant meeting substantially the OEM antifreeze coolant requirements of such selected set of OEM antifreeze coolant products; preferred step 510 of providing, in pre-packaged containers, antifreeze-color-dyes configured to color-match such at least one colorless vehicle-engine antifreeze coolant to the respective colors of the OEM antifreeze coolant products of such selected set; preferred step 515 of providing at least one chart-assessor structured and arranged to assist a user to chart-assess, relating to such at least one selected vehicle type, selection of such antifreeze-color-dye to be mixed with such at least one colorless vehicle-engine antifreeze coolant to color-match such at least one colorless vehicle-engine antifreeze coolant to the respective color of the user's OEM antifreeze coolant product; and preferred step 520 providing at least one point of sale display containing such pre-packaged containers of such at least one colorless vehicle-engine antifreeze coolant, such pre-packaged containers of such antifreeze-color-dye, and at least one chart-assessor. The above-described preferred steps of method 500 enable end-user dying of the colorless pre-packaged vehicle-engine antifreeze coolant to economically provide at least one selected vehicle-engine antifreeze-coolant color for at least one selected vehicle type.

Although applicant has described applicant's preferred embodiments of this invention, it will be understood that the broadest scope of this invention includes modifications. Such scope is limited only by the below claims as read in connection with the above specification. Further, many other advantages of applicant's invention will be apparent to those skilled in the art from the above descriptions and the below claims.

What is claimed is:

1. A system relating to custom dying colorless pre-packaged vehicle engine coolant antifreeze to economically provide at least one desired engine coolant color for at least one selected vehicle type, comprising:

a) at least one plurality of pre-packaged containers of colorless vehicle engine coolant antifreeze; and b) at least one plurality of antifreeze-color-dye containers;

c) wherein each said at least one plurality of antifreeze-color-dye container comprises at least one antifreeze color-dye structured and arranged to color dye at least one of said at least one plurality of pre-packaged containers of colorless vehicle engine coolant antifreeze;

d) wherein a selected quantity of colorless pre-packaged vehicle engine coolant antifreeze may be custom colored by transferring color-dye from at least one of said at least one plurality of antifreeze color-dye containers to at least one selected quantity of colorless pre-packaged vehicle engine coolant antifreeze.

2. The system according to claim 1 wherein said antifreeze color-dye comprises at least one pre-measured color-dye packet structured and arranged to color dye at least one said at least one pre-packaged container of colorless coolant.

3. The system according to claim 2 wherein said at least one antifreeze dye comprises at least one squeezable packet structured and arranged to assist transfer of the dye to at least one said at least one pre-packaged antifreeze container.

4. The system according to claim 3 wherein said at least one pre-packaged container of colorless vehicle engine coolant antifreeze comprises at least hybrid organic acid technology antifreeze (HOAT).

5. The system according to claim 4 wherein said at least one pre-packaged container of colorless vehicle engine coolant antifreeze at least meets the ASTM International D6210 standard for ethylene glycol coolant.

6. The system according to claim 5 wherein said at least one pre-packaged antifreeze container comprises at least one container structured and arranged to contain from about one-gallon to about 5-gallons of colorless anti-freeze.

7. The system according to claim 5 wherein each said at least one plurality of antifreeze-color-dye containers comprises at least one-half ounce of concentrated dye structured and arranged to color-dye at least one one-gallon pre-packaged container of colorless coolant.

8. The system according to claim 1 wherein said at least one pre-packaged antifreeze container comprises at least one about one-gallon container.

9. The system according to claim 1 wherein said at least one pre-packaged antifreeze container comprises at least one container structured and arranged to contain from about one-gallon to about 5-gallons of colorless anti-freeze.

10. The system according to claim 1 wherein said at least one pre-packaged container of colorless vehicle engine coolant antifreeze comprises at least hybrid organic acid technology antifreeze (HOAT).

11. The system according to claim 1 wherein said at least one pre-packaged container of colorless vehicle engine coolant antifreeze at least meets the ASTM International D6210 standard for ethylene glycol coolant.

12. The system according to claim 1 wherein said at least one pre-packaged container of colorless vehicle engine coolant antifreeze comprises at least one concentration of freeze protection chemical.

13. The system according to claim 1 further comprising at least one chart-assessor adapted to chart-assess, relating to such at least one selected vehicle type, the at least one desired engine coolant color.

14. The system according to claim 1 wherein each said at least one plurality of antifreeze-color-dye containers comprises at least one-half ounce of concentrated dye structured and arranged to color-dye at least one one-gallon pre-packaged container of colorless coolant.

15. A system relating to user-selection of at least one custom-dyable colorless pre-packaged vehicle engine coolant antifreeze to economically provide at least one desired engine coolant color for at least one selected vehicle type, comprising:

a) at least one point of sale display comprising
   i) at least one plurality of pre-packaged containers of colorless vehicle engine coolant antifreeze;
   ii) at least one plurality of antifreeze-color-dye containers;
   iii) wherein each said at least one plurality of antifreeze-color-dye containers is structured and arranged to color dye at least one of said at least one plurality of pre-packaged containers of colorless vehicle engine coolant antifreeze;
   iv) at least one chart-assessor structured and arranged to chart-assess, relating to such at least one selected vehicle type, the at least one desired engine coolant color;
   v) wherein said at least one chart-assessor comprises at least one color-dye selector structured and arranged to assist selection of at least one color-dye container relating to such at least one selected vehicle type antifreeze color;
   vi) wherein a selected quantity of colorless pre-packaged vehicle engine coolant antifreeze may be custom colored by transferring color-dye from at least one of said at least one plurality of antifreeze color-dye containers to at least one selected quantity of colorless pre-packaged vehicle engine coolant antifreeze;
   vii) wherein a selected quantity of colorless pre-packaged vehicle engine coolant antifreeze may be custom colored by transferring color-dye from at least one of said at least one plurality of antifreeze color-dye containers to at least one selected quantity of colorless pre-packaged vehicle engine coolant antifreeze; and b) wherein at least one user-selection of the at least one custom dyable colorless pre-packaged vehicle engine coolant antifreeze to economically provide at least one desired engine coolant color for at least one selected vehicle type is provided.

16. The system according to claim 15 wherein said at least one chart-assessor comprises at least one electronic interface structured and arranged to assist user-selection of at least one color-dye container relating to such at least one selected vehicle type antifreeze color.

17. The system according to claim 15 wherein said at least one point of sale display comprises at least one electronic interface structured and arranged to assist user-selection of such at least one selected vehicle type antifreeze and anti-freeze color.

18. The system according to claim 15 wherein each said at least one plurality of antifreeze-color-dye containers comprises at least one-half ounce of concentrated dye structured and arranged to color-dye at least one one-gallon pre-packaged container of colorless coolant.

19. The system according to claim 15 wherein said at least one pre-packaged antifreeze container comprises at least one container structured and arranged to contain from about one-gallon to about 5-gallons of colorless anti-freeze.

20. A method relating to providing of products enabling end-user dying of at least one colorless pre-packaged vehicle-engine antifreeze coolant to economically provide at least one selected vehicle-engine antifreeze-coolant color for at least one selected vehicle type, comprising the steps of:

a) assessing (OEM) antifreeze coolant requirements and colors for at least one selected set of (OEM) antifreeze coolant products;
b) providing, in pre-packaged containers, at least one colorless vehicle-engine antifreeze coolant meeting substantially the (OEM) antifreeze coolant requirements of such selected set of (OEM) antifreeze coolant products;
c) providing, in pre-packaged containers, antifreeze-color-dyes configured to color-match such at least one colorless vehicle-engine antifreeze coolant to the respective colors of the (OEM) antifreeze coolant products of such selected set;
d) providing at least one chart-assessor structured and arranged to assist a user to chart-assess, relating to such at least one selected vehicle type, selection of such anti-freeze-color-dye to be mixed with such at least one colorless vehicle-engine antifreeze coolant to color-match such at least one colorless vehicle-engine antifreeze coolant to the respective color of the user's (OEM) anti-freeze coolant product; and
e) providing at least one point of sale display containing such pre-packaged containers of such at least one colorless vehicle-engine antifreeze coolant, such pre-packaged containers of such antifreeze-color-dye, and at least one chart-assessor;

f) wherein products enabling end-user dying of such at least one colorless pre-packaged vehicle-engine antifreeze coolant to economically provide the at least one selected vehicle-engine antifreeze-coolant color for the at least one selected vehicle type are provided.

* * * * *